US005140696A

United States Patent [19]

Fox

[11] Patent Number: 5,140,696

[45] Date of Patent: Aug. 18, 1992

[54] COMMUNICATION SYSTEM FOR TRANSMITTING DATA BETWEEN A TRANSMITTING ANTENNA UTILIZING STRIP-LINE TRANSMISSION LINE AND A RECEIVE ANTENNA IN RELATIVE MOVEMENT TO ONE ANOTHER

[75] Inventor: Timothy R. Fox, Chicago, Ill.

[73] Assignee: Kabushiki Kaisha Toshiba, Kanagawa, Japan

[21] Appl. No.: 317,026

[22] Filed: Feb. 28, 1989

[51] Int. Cl.[5] ..... H05G 1/06

[52] U.S. Cl. ..... 455/41; 343/763; 378/15

[58] Field of Search ..... 455/39, 40, 41, 80, 455/81, 133-136, 327, 333, 132; 343/702, 700 MS, 757, 763; 333/237, 261; 340/870.3, 552; 378/15

[56] References Cited

U.S. PATENT DOCUMENTS 4,035,728 7/1977 Ishikawa et al. ..... 455/132
4,476,574 10/1984 Struven ..... 455/41
4,538,125 8/1985 Beckmann et al. ..... 343/763
4,541,120 9/1985 Szabo ..... 455/327
4,742,571 5/1988 Letron ..... 455/327
4,796,183 1/1989 Ermert et al. ..... 378/15
4,912,471 3/1990 Tyburski et al. ..... 455/41

*Primary Examiner*—Curtis Kuntz
*Attorney, Agent, or Firm*—Finnegan, Henderson, Farabow, Garrett and Dunner

[57] ABSTRACT

A communication system for transmitting data between a transmitting platform and a receiving platform moving relative to each other. A circular strip-line transmission line forms the transmitting antenna located on the transmitting platform and a short segment of strip-line, similar in width to the circular strip-line, forms the receive antenna located on the receiving platform. The strip-line transmission line has at least two feedpoints for inputting data and at least two termination points that are terminated with a resistor to ground. The receive antenna is mounted close to the transmitting antenna.

21 Claims, 4 Drawing Sheets

COMMUNICATION SYSTEM FOR TRANSMITTING DATA BETWEEN A TRANSMITTING ANTENNA UTILIZING STRIP-LINE TRANSMISSION LINE AND A RECEIVE ANTENNA IN RELATIVE MOVEMENT TO ONE ANOTHER

BACKGROUND OF THE INVENTION

The present invention relates to a communication system and, more particularly, to a system for transmitting data between a transmitting platform and a receiving platform using a strip-line transmission line as the transmitting antenna located on the transmitting platform.

For cross reference purposes, the existence of a concurrently filed application, Ser. No. 07/316,991, is noted. This application, entitled "Communication System for Transmitting Data Between a Transmitting Antenna Utilizing Leaky Coaxial Cable and a Receive Antenna in Relative Movement to One Another," by Timothy R. Fox and Jerry Posluszny, is commonly owned by the same assignee.

A communication system for transmitting data between a rotating platform and a stationary platform finds particular utility in CT scanners. The data come from a transmitter source and are applied to a suitable modulator that modulates a sinusoidal radio-frequency carrier signal. The modulated carrier signal is applied to the feedpoint of the transmitting antenna. the transmitter carrier source, the suitable modulator and the transmitting antenna are mounted on the transmitting platform, and the transmitting platform is rotating.

The transmission often is achieved using brushes sliding against slip rings to make a set of electrical connections between the rotating and stationary platforms. This mechanical contact causes a number of problems, however. One problem is that the mechanical interface is highly susceptible to wear. A second problem is that the mechanical interface achieves only intermittent electrical contact.

Thus, a problem with present CT scanners is that a large portion of the equipment rotates, but the data received from the rotating equipment must be communicated to a computer that does not rotate. Aside from the mechanical linkages discussed above, other CT scanners use flexible cables to connect the rotating platform to the fixed platform. As a result, most present CT scanners cannot allow the platform to rotate continuously. Thus, the rotating platform will make, for example, two rotations and then the transmitting cable must be rewound and the rotations started over again for another two rotations. This procedure causes wear on, and early destruction of, the cables. Moreover, the scanning procedure is rendered unnecessarily long because the platform cannot continuously rotate.

SUMMARY OF THE INVENTION

Accordingly, it is an object of the invention to provide a communication system for transmitting data between a transmitting platform and a receiving platform that eliminates the mechanical interface and the wear of mechanical apparatus as the receive antenna located on the receiving platform moves along the transmitting antenna located on the transmitting platform.

It is another object of the present invention to provide a communication system for transmitting data between a transmitting platform and a receiving platform that has continuous electrical contact as the receive antenna located on the receiving platform moves along the transmitting antenna located on the transmitting platform.

It is a further object of the present invention to permit continuous relative rotation between the transmitting platform and the receiving platform, thereby increasing the life of the transmitting antenna and decreasing the time necessary to complete a CT scan procedure.

The objects given above are accomplished, in part, using a strip-line transmission line as the transmitting antenna and by forming the transmitting antenna into a circle. Additional objects and advantages of the present invention will be set forth in part in the description that follows and in part will be obvious from the description or may be learned by practice of the invention. The objects and advantages of the invention may be realized and obtained by the methods and apparatus particularly pointed out in the appended claims.

To achieve the objects and in accordance with the purpose of the invention, as embodied and as broadly described herein, a communication system for transmitting data between a transmitting platform and a receiving platform, the transmitting and receiving platforms moving relative to each other, comprises: a transmitting antenna located on the transmitting platform, the transmitting antenna having a circular strip-line; driving means for inputting data to the transmitting antenna; a receive antenna located on the receiving platform and being maintained a first predetermined distance from the transmitting antenna; and receiving means for receiving data from the receive antenna.

According to a second embodiment of the invention, a communication system for transmitting data between a transmitting platform and a receiving platform, the transmitting and receiving platform moving relative to each other, comprises: a transmitting antenna located on the transmitting platform, the transmitting antenna having a circular strip-line; driving means for inputting data to the transmitting antenna; at least two receive antennas located on the receiving platform and being maintained a first predetermined distance from the transmitting antenna; and at least two receiving means for receiving data from the receive antennas.

According to a further embodiment of the invention, a communication system for transmitting data between a transmitting platform and a receiving platform, the transmitting and receiving platforms moving relative to each other, comprises: a transmitting antenna located on the transmitting platform, the transmitting antenna having at least two concentric circular striplines; driving means for inputting data to the transmitting antenna; a receive antenna located on the receiving platform and being maintained a first predetermined distance from the transmitting antenna; and receiving means for receiving data from the receive antenna.

The accompanying drawings, which are incorporated in and constitute a part of this specification, illustrate several embodiments of the invention and, together with the description, serve to explain the principles of the invention.

DESCRIPTION OF THE PREFERRED EMBODIMENTS

Figure 1:
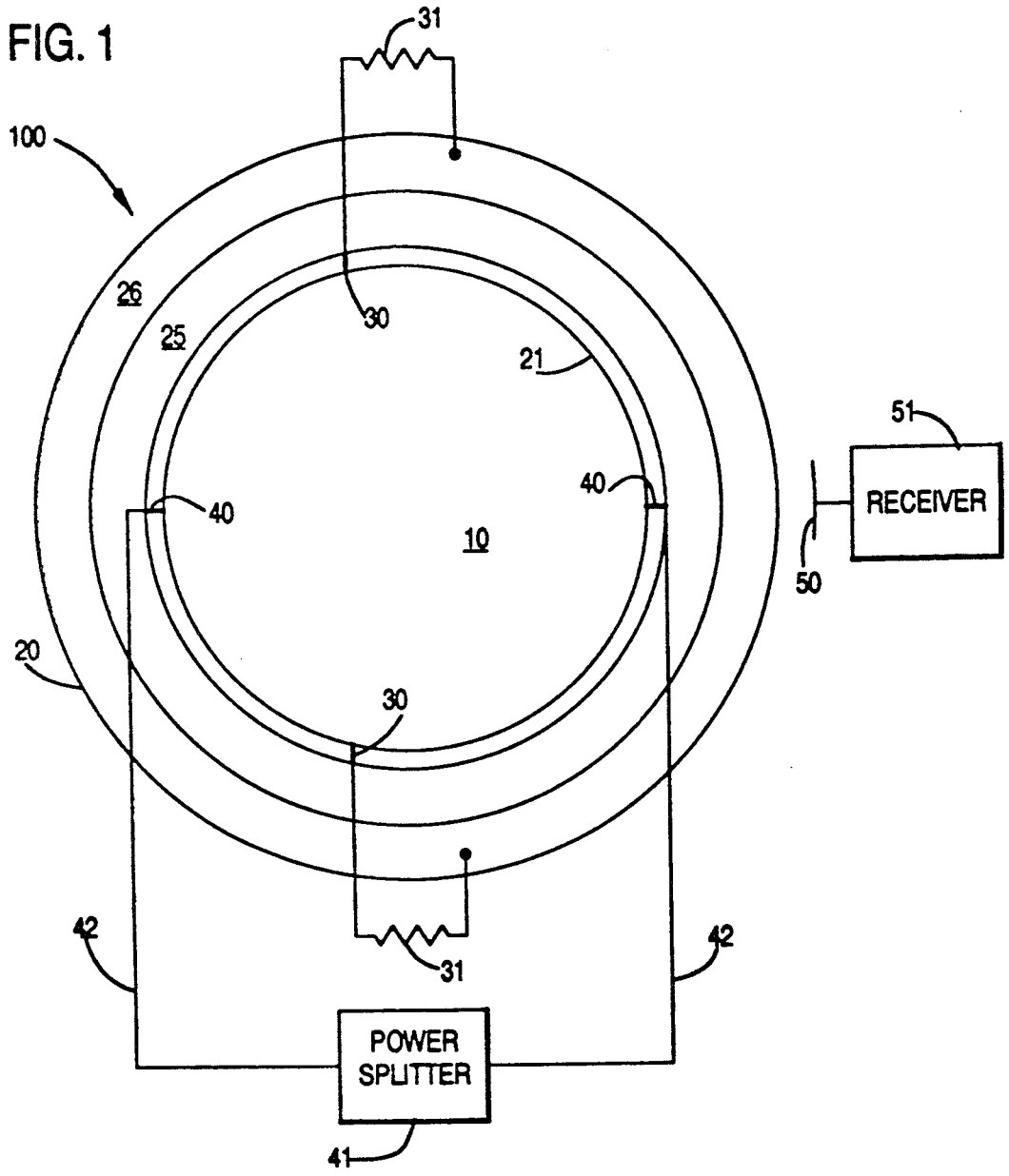
FIG. 1 is a functional block diagram depicting a first embodiment of a communication system for transmitting data between a transmitting platform and a receiving platform wherein the transmitting antenna located on the transmitting platform is a circular stripline.

Reference will now be made in detail to the presently preferred embodiments of the invention, examples of which are illustrated in the accompanying drawings. Throughout the drawings, like reference characters are used to indicate like elements.

A preferred embodiment of the communication system according to the present invention is shown in FIG. 1 and is generally designated by reference character 100. As explained further hereinbelow, system 100 is a communication system for transmitting data between a transmitting platform and a receiving platform in relative movement to one another.

Figure 4:
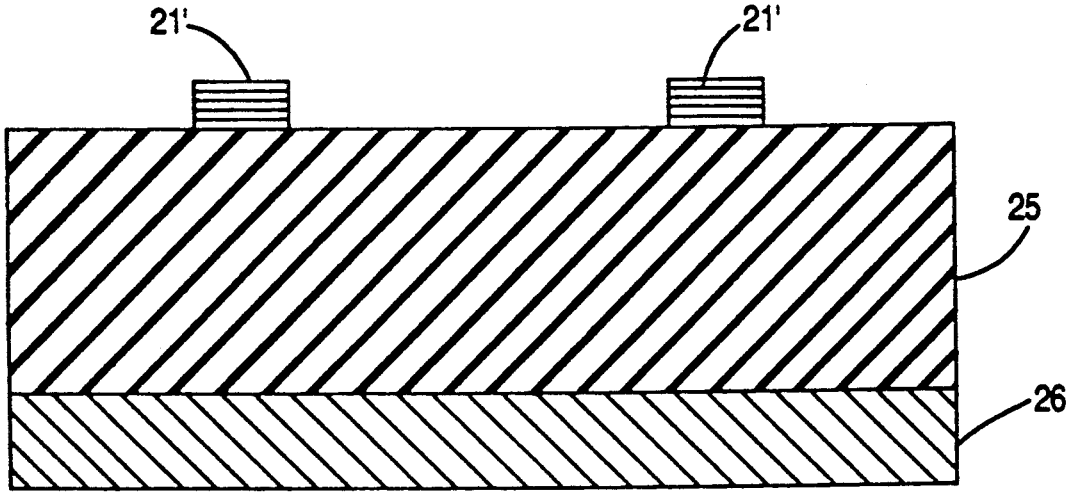
FIG. 4 is a partial cross-sectional view of the transmitting platform depicting a top surface made of dielectric material, a bottom surface made of copper and two strip line transmission lines located on the top surface.

According to the present invention, a transmitting antenna 10 is provided, located on a transmitting platform 20 having a circular strip-line 21. As embodied herein, transmitting platform 20 has a top surface made of a suitable dielectric material 25 and a bottom surface made of a solid sheet of copper 26 (see also FIG. 4). According to the presently preferred embodiment, transmitting platform 20 is either an annular disc or a drum. Other structures are considered to be apparent to those skilled in the art and are considered within the scope of the invention.

Circular strip-line 21 has at least two termination points 30. Each of termination points 30 is terminated with a resistor 31 to ground, as provided by copper sheet 26 (see also FIG. 4). According to the embodiment illustrated in FIG. 1, termination resistors 31 are each preferably equal to one-half the characteristic impedance of circular strip-line 21 in order to avoid losses in transmission.

Circular strip-line 21 also has at least two feedpoints 40 for inputting data. The impedance seen at each of feedpoints 40 is preferably one-half the characteristic impedance of circular strip-line 21 in order to avoid transmission losses. According to the present invention, a driving means is provided for inputting data to transmitting antenna 10 at feedpoints 40. As embodied herein, the driving means is designated by reference character 41 and may include a power splitter. The power splitter of driving means 41 can be mounted a distance of approximately four (4) meters from feedpoints 40 and can be connected to feedpoints 40 with two matched-length normal coaxial cables 42 of the same characteristic impedance. Other distances between the power splitter and the feedpoints can be used and are considered within the scope of the invention. Power splitter includes a resistor network, a transformer-coupled hybrid network or a transmission line network (not shown). Such networks permit tight controls on the phase shift and equality of power splitting between the two outputs of the power splitter. If both outputs from power splitter are terminated with the correct impedance, the voltage across the load impedances will be equal and in phase. Such networks are well known in the art and need not be described for purposes of the present invention.

The present invention further provides a receive antenna. As embodied herein, the receive antenna is designated by reference character 50. Receive antenna 50 is a short segment of strip-line transmission line similar in width and spacing corresponding to that of the circular strip-line transmission line of transmitting antenna 10.

The present invention further provides a receiving means for receiving data from receive antenna 50. As embodied herein, the receiving means is designated by reference character 51. Receiving means 51 includes an amplifier or a receiver, a suitable filter, and a detector for the frequency and modulation employed. According to the presently preferred embodiment, the first amplifier of receiving means 51 is located on the receiving platform approximately less than ten (10) centimeters from receive antenna 50. Other distances between the first amplifier of receiving means 51 and receive antenna 50 may be employed, however, and are considered within the scope of the invention.

The present invention also provides that receive antenna 50 be maintained approximately one to two (1-2) millimeters from transmitting antenna 10. Other distances between receive antenna 50 and transmitting antenna 10 that will ensure that receive antenna 50 is in the near field of transmitting antenna 10 may be used and are considered within the scope of the invention. At two termination points 30 and at feedpoints 40, receive antenna 50 is disposed to clear the connections for termination resistors 31 and feedpoints 40 without causing large changes in the spacing between transmitting antenna 10 and receive antenna 50.

An elementary version of this invention employing relative movement between a receiving antenna and a transmitting antenna involves linear translation, rather than rotation between a transmitter and a receiver. The linear translation system uses a terminated length of strip-line transmission line as the transmitting antenna. The strip-line transmission line comprises a long strip of relatively thin conductor spaced away from a ground plane by a suitable dielectric material and terminated by a resistor equal to the characteristic impedance of the transmission line. The linear translation system uses a small receive antenna moving along the unshielded, or top, side of the transmission line to receive the data. The receive antenna senses the electrical field near the strip conductor, which is the measure of voltage in the conductor in a small region under the receive antenna. In this near field region, the receive antenna is sensing the field from the local voltage on the transmission line instead of picking up the radiated electromagnetic wave of an entire antenna in the far field region.

If the loss in the line and the power radiated to the receive antenna and into free space are low, then most of the power applied to the first end of the transmission line will travel down the transmission line and dissipate in the termination resistor at the far end. If the termination resistor is a good match to the characteristic impedance of the line, then the power reflected back toward the first end of the line will be minimal. Absent reflection, the transmission line is "non-resonant". Thus, the impedance at a feedpoint is independent of frequency and there is no standing wave on the line. A standing wave would give a voltage and current intensity pattern that is stationary in time but varies periodically with distance along the length of the strip-line. The intensity will vary with distance because of energy radiated away and energy dissipated in the internal losses of the strip-line. These will cause a monotonic decrease in intensity along the transmission line.

A number of problems exist with this elementary version of the invention, however. When using a carrier-frequency traveling wave in the transmission line, the phase difference at the carrier frequency between the sinusoidal voltage at the feedpoint of the transmitting antenna and the voltage at a point along the length of the transmission line will be a linear function of the position. The phase difference is caused by the delay due to the finite speed of propagation of the wave traveling down the line. If the carrier-frequency traveling wave is modulated by a pulse, a relative delay between the pulse waveform at the feedpoint and at a point farther down the line also will be present. In addition, as the receive antenna slides along the transmitting antenna cable away from the feedpoint, the transmission line losses and leakage will cause a decrease in the signal intensity. These problems can be overcome by a preferred embodiment of the communication system.

Operation of the invention will now be explained with reference to the preferred embodiment illustrated in FIG. 2. The presently preferred operation provides that data are input to transmitting antenna 10 via the power splitter of driving means 41. The data input to feedpoints 40 on the circular strip-line are equal signals, in phase from a common source, and include a serial stream of binary values encoded to include error correction capability. A suitable sinusoidal voltage generator makes a "carrier" voltage, and this carrier voltage turns on and off in response to the binary value of the data stream. At receive antenna 50 the output signal is amplified to a voltage level high enough to allow an amplitude detector to demodulate the signal at receiving means 51. The demodulated signal is then applied to a voltage comparator to discriminate between carrier on and carrier off conditions.

An alternative operation of the device is to apply input data of a serial stream of binary values to a frequency modulator. The frequency modulator makes a "mark" and "space" frequency in response to the binary value of the data stream. The output signal is demodulated by a suitable frequency demodulator at receiving means 51. The demodulated signal is then discriminated between the mark and space frequency.

Other arrangements for developing the data signals are considered to be within the scope of the invention and are considered to be apparent to those skilled in the art.

If the system is unstable, or if the operating frequency is changed often, a superheterodyne system may be used with either the amplitude modulation or the frequency modulation receive antenna 50 and the antenna signal is converted to an intermediate frequency for convenient detection.

If there is excessive interference to the receive antenna from outside sources or if the transmitting antenna produces excessive interference to outside devices, the entire system, i.e., the transmitting antenna and the receive antenna may be enclosed inside a suitable metal shield. According to the presently preferred embodiment, the metal shield is an annular box with a rectangular cross section cut into two parts. One part shields the transmitting platform, the other shields the receiving platform. The two sections of metal shield are rotating in relation to each other. Other structures are considered to be apparent to those skilled in the art in view of this disclosure and are considered within the scope of the invention.

A further embodiment of the communication system according to the present invention will now be discussed with respect to FIG. 2. Since this embodiment differs from the preferred embodiment only with respect to details of the receive antenna and the receiving means, most of the structural details discussed above are not discussed further. For the sake of simplicity, however, it is to be understood that such structures are incorporated in and form a part of the embodiment discussed below. Thus, the discussion below focusses only on those elements that differ from the structures and operations present in the preferred embodiment illustrated in FIG. 1.

Figure 2:
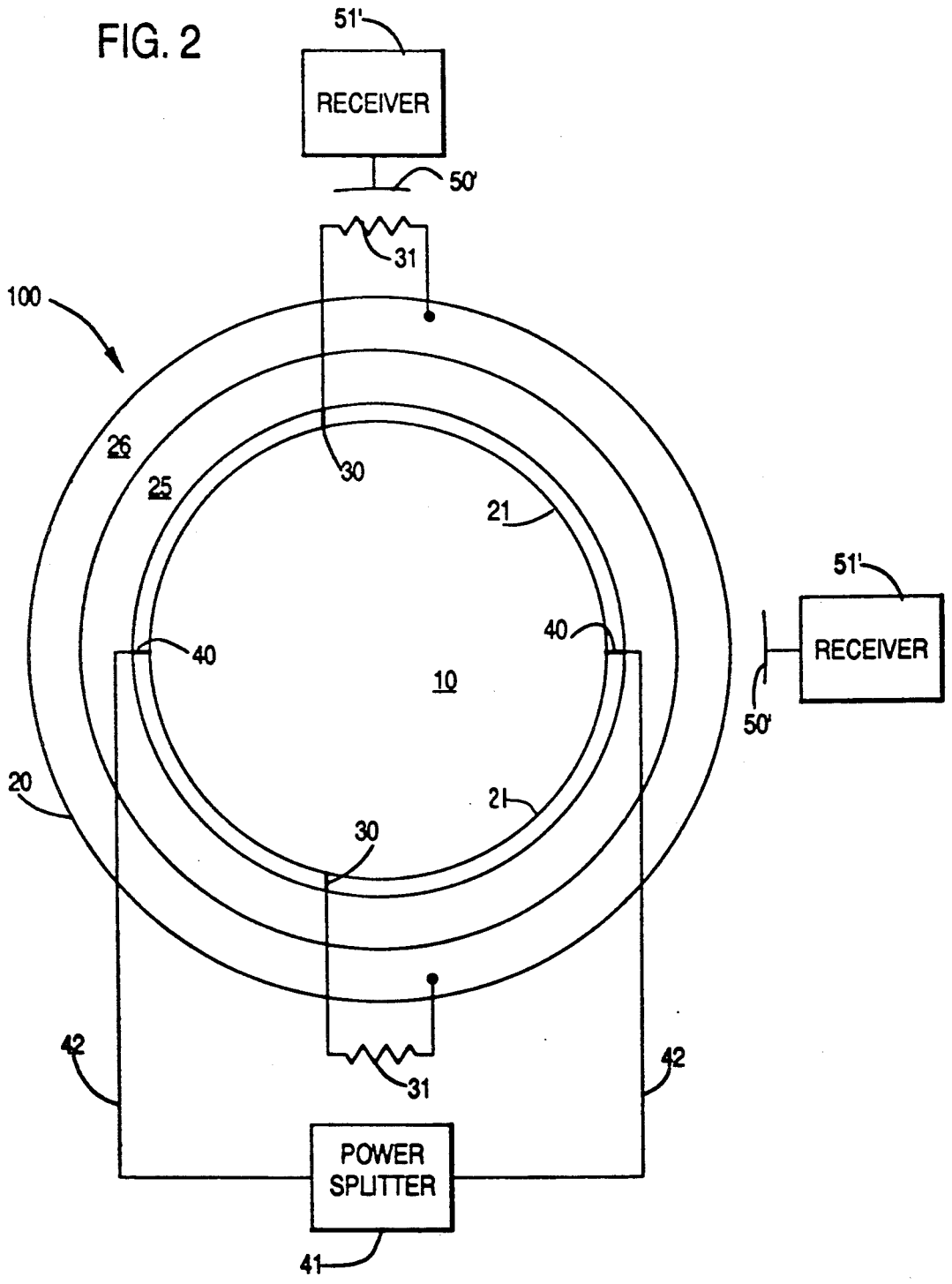
FIG. 2 a functional block diagram depicting a second embodiment of a communication system for transmitting data between a transmitting platform and a receiving platform showing at least two receive antennas and receiving means.

Turning to the embodiment of a communication system according to the present invention illustrated in FIG. 2, it is seen that more than one receive antenna 50' and receiving means 51' are used. Receive antennas 50' are approximately ninety degrees (90°) apart. Other configurations are considered to be apparent to those skilled in the art in view of this disclosure and are considered within the scope of the present invention.

The operation of the second embodiment involves demodulating the signals at each receiving means 51' separately. The separate demodulator outputs are then either combined or selected to get a better signal to discriminate.

Figure 3:
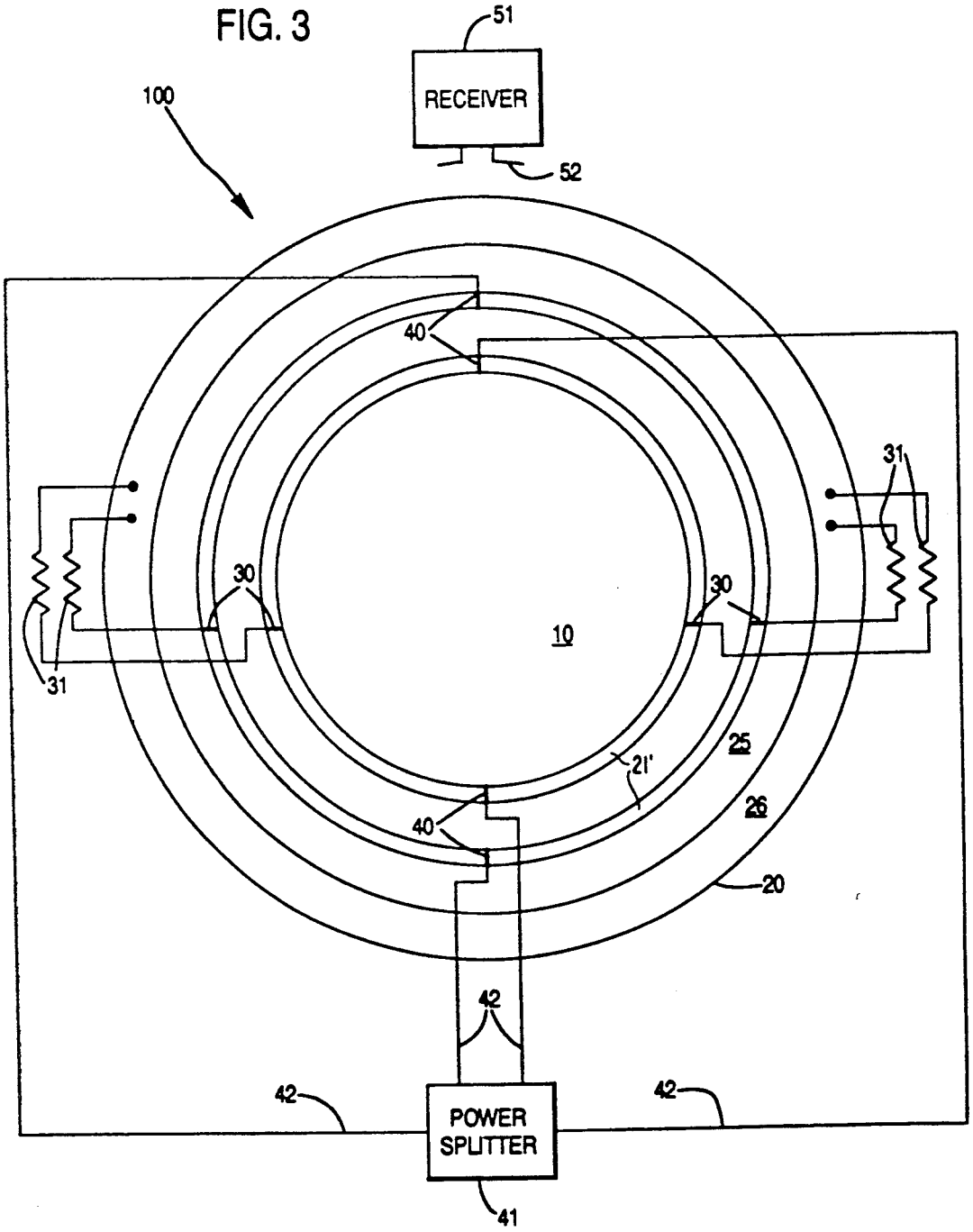
FIG. 3 is a functional block diagram depicting a third embodiment of a communication system for transmitting data between a transmitting platform and a receiving platform showing that the transmitting antenna comprises at least two concentric circular strip-lines.

Another embodiment of the communication system according to the present invention will be now be discussed with respect to FIG. 3. Since this embodiment differs from the preferred embodiment only with respect to the details of the transmitting antenna, most of the structural details discussed above are not discussed further. For the sake of simplicity it is to be understood that such structures are incorporated in and form a part of the embodiment discussed below. Thus, the discussion below focuses only on those elements that differ from the structures and operations present in the preferred embodiment illustrated in FIG. 1 and in FIG. 2.

Turning to the embodiment of a communication system according to the present invention illustrated in FIG. 3, it is seen that transmitting antenna 10 comprises at least two concentric circular strip-lines 21' so that the transmission line is balanced with respect to the ground plane. Receive antenna 52 is made with at least two capacitor plates to sense the difference in voltage between concentric circular strip-lines 21'.

The present invention may, therefore, be summarized as providing a communication system for transmitting data between a transmitting platform and a receiving platform using a strip-line transmission line as the transmitting antenna located on the transmitting platform wherein there is no mechanical interface and wear on mechanical apparatus, and there is continuous electrical contact as the receive antenna slides along the transmitting antenna. Furthermore, the present invention allows continuous relative rotation between the transmitting and receiving platforms thereby increasing the life of the transmitting antenna and decreasing the time necessary to complete a CT scan procedure, for example.

It will be apparent to those skilled in the art that modifications and variations can be made in the communication system of the present invention. The invention in its broader aspects is, therefore, not limited to the specific details, representative methods and apparatus, and illustrated examples shown and described herein. Thus, it is intended that all matter contained in the foregoing description and shown in the accompanying drawings, shall be interpreted as illustrative and not in a limiting sense.

What is claimed is:

1. A communication system for transmitting data between a transmitting platform and a receiving platform, the transmitting and receiving platforms moving relative to each other, comprising:

a transmitting antenna located on the transmitting platform, the transmitting antenna having a circular strip-like wherein the circular strip-line at least two feedpoints being diametrically opposed and has at least two termination points being diametrically opposed and 90° from the at least two feedpoints;

driving means for inputting data to the transmitting antenna;

a receive antenna located on the receiving platform and being maintained a first predetermined distance from a plane of the transmitting antenna; and receiving means for receiving data from the receive antenna.

2. The communication system as recited in claim 1 wherein the transmitting platform has a top surface made of a dielectric material.

3. The communication system as recited in claim 1 wherein the transmitting platform has a bottom surface including a solid sheet of copper.

4. The communication system as recited in claim 1 wherein the transmitting platform has a bottom surface, and the termination points are terminated with a resistor to the bottom surface of the transmitting platform.

5. The communication system as recited in claim 1 wherein the driving means includes a power splitter.

6. The communication system as recited in claim 1 wherein the receive antenna is a segment of strip-line having a width corresponding to width of the circular strip-line of the transmitting antenna.

7. The communication system as recited in claim 1 wherein the receiving means is maintained a second predetermined distance from a flame of the receive antenna.

8. A communication system for transmitting data between a transmitting platform and a receiving platform, the transmitting and receiving platform moving relative to each other, comprising:

a transmitting antenna located on the transmitting platform, the transmitting antenna having a circular strip-line, wherein the strip-line has at least two feedpoints being diametrically opposed and at least two termination points being diametrically opposed and 90° from the at least feedpoints;

driving means for inputting data to the transmitting antenna;

at least two receive antennas located on the receiving platform and maintained a first predetermined distance from a plane of the transmitting antenna; and at least two receiving means for receiving data from the receive antennas.

9. The communication system as recited in claim 8 wherein the transmitting platform has a top surface made of a dielectric material.

10. The communication system as recited in claim 8 wherein the transmitting platform has a bottom surface including a a solid sheet of copper.

11. The communication system as recited in claim 8 wherein the transmitting platform has a bottom surface and the two termination points are terminated with a resistor to the bottom surface of the transmitting platform.

12. The communication system as recited in claim 8 wherein the driving means includes a power splitter.

13. The communication system as recited in claim 8 wherein the receive antennas each are a segment of strip-line having a width corresponding to a width of the circular strip-line of the transmitting antenna.

14. The communication system as recited in claim 8 wherein the receiving means are maintained a second predetermined distance from a plane of the two receive antennas.

15. A communication system for transmitting data between a transmitting platform and a receiving platform, the transmitting and receiving platforms moving relative to each other, comprising:

a transmitting antenna located on the transmitting platform, the transmitting antenna having at least two concentric circular strip-lines wherein the radial spacing between the two concentric circular strip-lines is less than the radius of the two concentric circles, and each of the concentric circular strip-lines has at least two feedpoints between diametrically opposed and at least two terminations points being diametrically opposed and 90° from the at least two feedpoints;

driving means for inputting data to the transmitting antenna;

a receive antenna located on the receiving platform and being maintained a first predetermined distance from a plane of the transmitting antenna; and receiving means for receiving data from the receive antenna.

16. The communication system as recited in claim 15 wherein the transmitting platform has a top surface made of a dielectric material.

17. The communication system as recited in claim 15 wherein the transmitting platform has a bottom surface including a solid sheet of copper.

18. The communication system as recited in claim 15 wherein the transmitting platform has a bottom surface, and the termination points are terminated with a resistor to the bottom surface of the transmitting platform.

19. The communication system as recited in claim 15 wherein the driving means includes a power splitter.

20. The communication system as recited in claim 15 wherein the receive antenna includes at least two segments of strip-line having a width corresponding to a width of the concentric strip-lines of the transmitting antenna.

21. The communication system as recited in claim 5 wherein the receiving means is maintained a second predetermined distance from a plane of the receive antenna.

* * * * *

UNITED STATES PATENT AND TRADEMARK OFFICE

CERTIFICATE OF CORRECTION

PATENT NO. : 5,140,696

DATED : August 18, 1992

INVENTOR(S) : Timothy R. Fox

It is certified that error appears in the above-indentified patent and that said Letters Patent is hereby corrected as shown below:

Claim 1, column 7, line 18, change "strip-like" to --strip-line--.

Claim 1, column 7, line 18, before "at" insert --has--.

Claim 7, column 7, line 49, change "flame" to --plane--.

Claim 8, column 7, line 61, before "feedpoints" insert --two--.

UNITED STATES PATENT AND TRADEMARK OFFICE

CERTIFICATE OF CORRECTION

PATENT NO. : 5,140,696

DATED : August 18, 1992

INVENTOR(S) : Timothy R. Fox

It is certified that error appears in the above-indentified patent and that said Letters Patent is hereby corrected as shown below:

Claim 10, column 8, line 8, change "a a" to --a--.

Claim 15, column 8, line 34, change "between" to --being--.

Claim 15, column 8, line 35, change "terminations" to --termination--.

Claim 21, column 8, line 62, change "claim 5" to --claim 15--.

Signed and Sealed this

Eighteenth Day of January, 1994

*Attest:*

*Attesting Officer*

BRUCE LEHMAN

*Commissioner of Patents and Trademarks*